US006663282B2

(12) United States Patent
Jeffries

(10) Patent No.: US 6,663,282 B2
(45) Date of Patent: Dec. 16, 2003

(54) SHOPPING BAG CONVERTIBLE TO POSTER

(75) Inventor: Michael S. Jeffries, Columbus, OH (US)

(73) Assignee: A & F Trademark, Inc., Wilmington, DE (US)

( * ) Notice: Subject to any disclaimer, the term of this patent is extended or adjusted under 35 U.S.C. 154(b) by 0 days.

(21) Appl. No.: 10/117,587

(22) Filed: Apr. 5, 2002

(65) Prior Publication Data

US 2003/0190095 A1 Oct. 9, 2003

(51) Int. Cl.[7] ..... B65D 30/00

(52) U.S. Cl. ..... 383/4; 383/127; 206/457; 206/736

(58) Field of Search ..... 383/4, 127; 283/56; 206/457, 736

(56) References Cited

U.S. PATENT DOCUMENTS 1,609,923 A * 12/1926 Wilson ..... 283/56
1,693,266 A * 11/1928 Baldwin ..... 139/383 R
1,925,930 A * 9/1933 Mulligan ..... 383/4
2,024,091 A * 12/1935 Colgate ..... 206/736
3,160,343 A * 12/1964 Schantzer ..... 383/4
3,430,761 A * 3/1969 Pelkey ..... 206/309
4,487,431 A * 12/1984 Kelly ..... 283/117
4,487,590 A * 12/1984 Becker et al. ..... 446/147
4,538,833 A * 9/1985 Trikilis ..... 281/2
5,234,231 A * 8/1993 Hollander et al. ..... 281/2
5,577,730 A * 11/1996 Vannozzi, Sr. ..... 273/260

FOREIGN PATENT DOCUMENTS

FR 002667846 A * 4/1992 ..... 383/127

* cited by examiner

*Primary Examiner*—Jes F. Pascua
(74) *Attorney, Agent, or Firm*—Colucci & Umans; Angelo Notaro; Peter C. Michalos

(57) ABSTRACT

A convertible shopping bag is made of a sheet of material having an outer surface and carries an image with a selected orientation. The sheet is formed into a bag having front and rear walls each with left, right, top and bottom edges. The edges are connected to each other to close a bottom and opposite sides of the bag, and to leave a top opening for receiving and discharging goods. The image has portions which are on at least part of each of the outer surfaces of the sheet at the front and rear walls so that with two of the connected edges disconnected, the bag is unfolded at the remaining connected edges to form a poster with all portions of the image in the correct orientation.

9 Claims, 3 Drawing Sheets

SHOPPING BAG CONVERTIBLE TO POSTER

FIELD AND BACKGROUND OF THE INVENTION

The present invention relates generally to the field of shopping bags, and, in particular, to a new and useful shopping bag that can be converted into an attractive poster, and to a method for such conversion.

U.S. Pat. No. 4,618,992 discloses a paper bag for containing take-out food from a restaurant that can be converted by the customer into a flat place mat.

U.S. Pat. No. 3,160,343 discloses a paper bag that is formed by folding and stitching a sheet of gift-wrapping paper. A line of holes or perforations along certain edges of the sheet allows a ribbon to be chain-stitched through the holes to secure the edges together.

U.S. Pat. No. 2,853,710 shows a paper shopping bag that has perforations that facilitate tearing the bag in such a way that it is converted into a costume such as a child might wear.

U.S. Pat. No. 2,000,242 shows a paper bag that is imprinted with a face so that it can be used as a mask.

A large variety of other bags, both of paper and of cloth, are know which can be converted from a bag into something other than a bag.

Modern shopping bags have evolved into more than a simple container for storing and transporting a shopper's purchases. Such bags, which can be made of various flexible materials such as paper, plastics, woven or non-woven fibers, and the like, have become a valuable vehicle for advertising, and are often saved by a shopper for future use, thus increasing the brand recognition impact of this relatively inexpensive commodity.

The present invention seeks to further enhance the usefulness and long-term impact of the shopping bag in a new and unique manner.

SUMMARY OF THE INVENTION

It is an object of the present invention to provide a convertible shopping bag made of a sheet of material having an outer surface that carries an image with a selected correct orientation. The sheet is formed into a bag having front and rear walls each with left, right, top and bottom edges. The edges are connected to each other to close a bottom and opposite sides of the bag, and to leave a top opening for receiving and discharging goods. The image has portions which are on at least part of each of the outer surfaces of the sheet at the front and rear walls so that with two of the connected edges disconnected, the bag is unfolded at the remaining connected edges to form a poster with all portions of the image in the correct orientation. The different portions of the image may be right-side up, down or side-ways on the bag, as long as the image wraps at least partly across both walls and makes sense when the bag is cut open to form the poster.

The bag may also include side and bottom panels connected between the edges, with portions of the image spanning the one or more side and/or bottom panels.

The image may, for example, be that of an standing or reclining person with the upper body on the front wall and the lower body of the rear wall.

For a standing figure the image may be side-ways when the bag opening is up, and part of the image may span one of the side panels. To convert to the poster, the bottom is cut entirely from the sheet and one of the side edges nearest the head of the figure, is cut. The bag walls and uncut side panel are then spread flat to form the poster which can then be rotated from a side-ways to an upright position, and mounted, e.g. using tape or poster mounting clay, to a solid surface such as a door or wall.

Since shopping bag can be quite large (e.g. 10" to 20" wide and the same or a different dimension tall) the resulting poster is likewise large, elongated and sticking.

For the image of a reclining figure, the effect is even more striking in that the figure has the same reclining pose on the bag as on the unfolded poster which can be mount in a horizontally elongated position.

Correlated parts of a poster image can also span the walls and panels of a bag from front top, across the bag bottom and up the rear wall. This type of bag is converted by cutting the side edges and unfolding the walls. Initially the front image may be upright and the rear image upside down so that a correctly oriented and correlated image results on the unfolded poster.

Fastening means such as two sided tape can be provide on inside surfaces of the bag which are strategically placed so that when the bag is cut and unfolded, the tapes can be used to mount the poster. This will add little to the cost of the bag but greatly enhances its utility.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
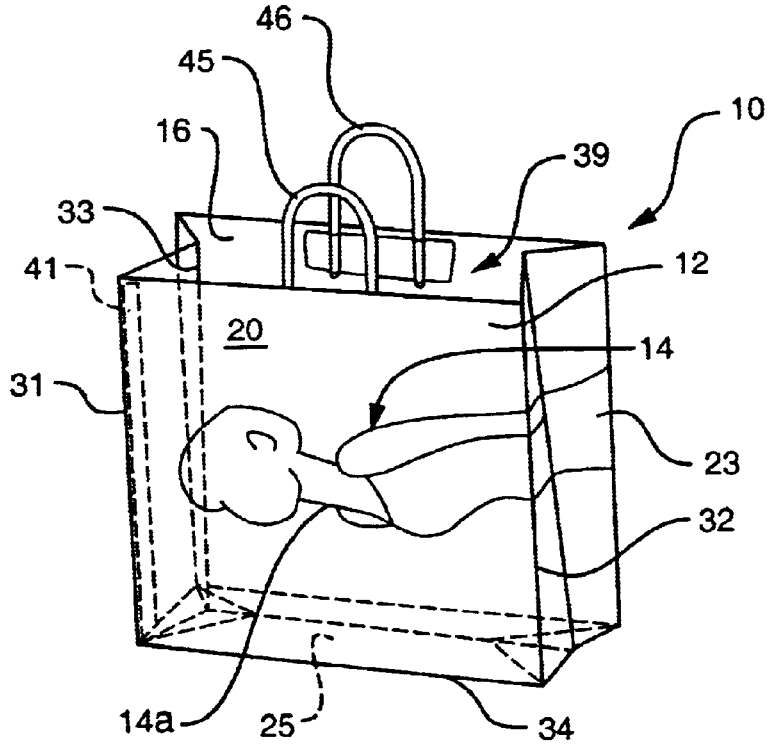
FIG. 1 is a front, right, top perspective view of a bag according to a first embodiment of the invention.

Referring now to the drawings, in which like reference numerals are used to refer to the same or functionally similar elements, FIG. 1 is a convertible shopping bag generally designated 10 which is made of a sheet of material having an outer surface 12 carrying an image 14, e.g. of a standing figure on a bicycle, with a selected orientation, e.g. side-ways in the upright position of the bag. The sheet also having an inner surface 16 forming the interior of the bag.

Means are provide in the form of folds and glue lines of know type, or any other appropriate method for forming the sheet into bag 10 having a front wall 20, with left, right, top and bottom edges 31, 32, 33 and 34 respectively, and a rear wall 22, likewise with left, right, top and bottom edges 35, 36, 37 and 38 respectively.

Figure 2:
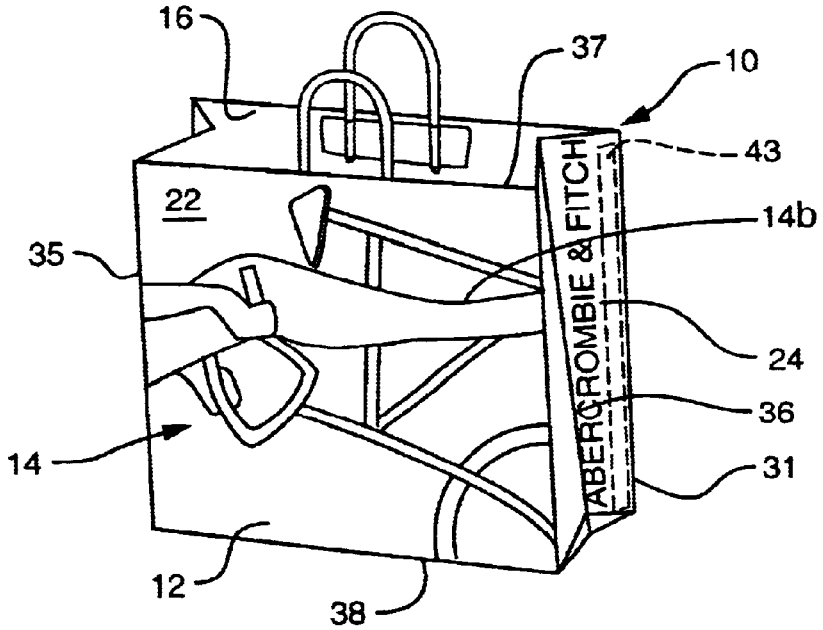
FIG. 2 is a rear, right, top perspective view of the bag of FIG. 1.

The bottom, left and right edges of the front and rear walls are connected to each other, through intermediate bottom and side panels in the embodiment of FIGS. 1 and 2, to close a bottom and opposite sides of the bag 10. The respective top edges 33 and 37 are free and defining an opening 39 for receiving and discharging goods to and from the bag.

The inner surfaces 16 of the sheet at the walls face each other on an interior of the bag.

The sheet is preferably flexible or semi-flexible, and can be make of any suitable shopping bag material such as, but not limited to, paper, cardboard, plastics, woven or non-woven fibers, cloth, and the like.

Figure 5:
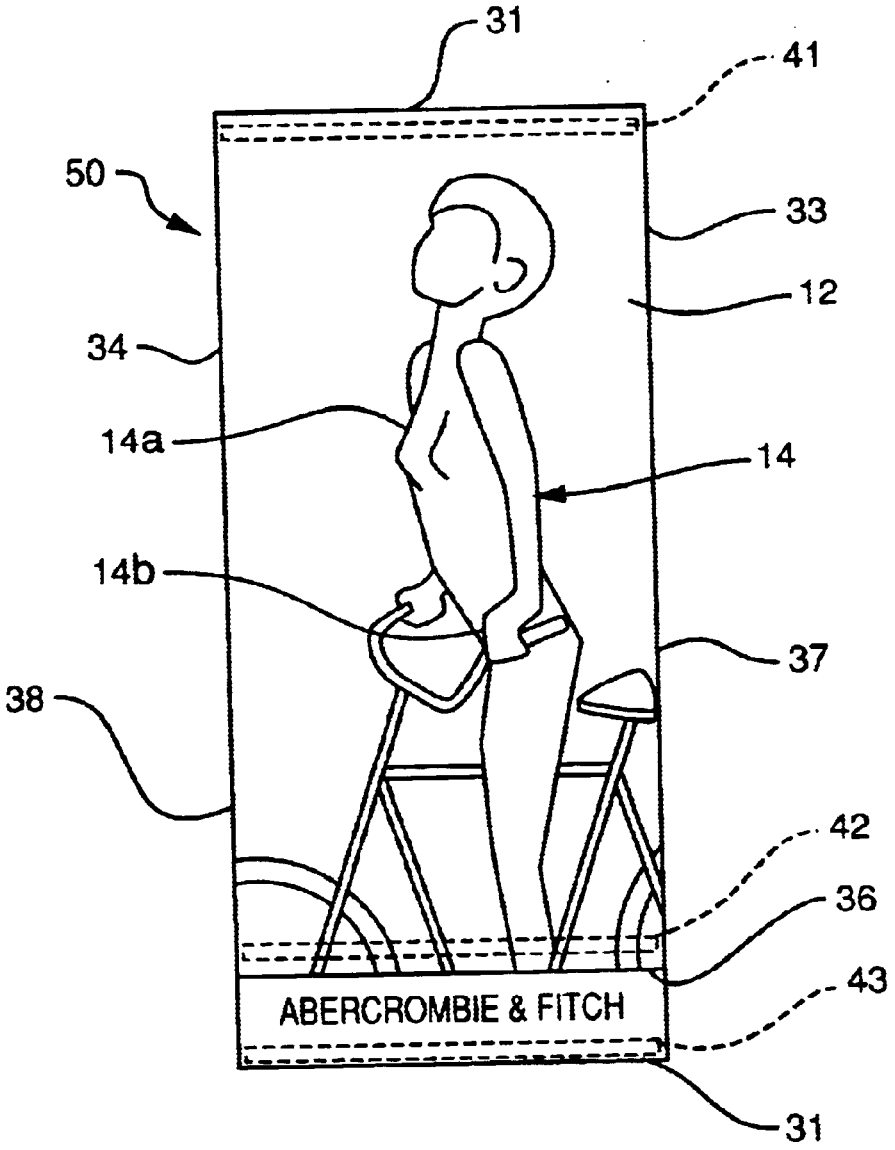
FIG. 5 is a front elevational view of a poster created from either the first or second embodiments of the invention.

The image 14 has portions, such as an upper body 14*a* and a lower body 14*b*, that are on at least part of each of the outer surfaces of the sheet at the front and rear walls 20 and 22, so that with two of the connected edges disconnected, such as the bottom edge 34 and the left side edge 31, the bag is unfolded at the remaining connected edges 32 and 36 to form a poster 50 shown in FIG. 5 with all portions of the image in the selected and correct orientation.

In the embodiment of FIGS. 1 and 2, the sheet includes a pair of side panels 23 and 24, formed by parts of the sheet, the side panels being connected between the left and right edges of the front and rear walls with portions of the image 14 spanning at least part of one or both side panels. The sheet also has parts making a bottom panel 25 between the bottom edges 34, 38.

With the bottom panel cut away at the front, rear and sides, and the edge 31 cut or disconnected, the image extends from the front wall, across side panel 23, onto the rear wall 22 and across the opposite side panel 24, in a side-ways orientation. The horizontally elongated sheet is then rotated to an upright position in FIG. 5.

The standing figure of image 14, is side-ways when the bag opening is up, and part of the image may span one or both of the side panels. To convert to the poster, the bottom is cut entirely from the sheet and one of the side edges nearest the head of the figure, is cut. The bag walls and uncut side panel are then spread flat to form the poster which can then be rotated from a side-ways to an upright position, and mounted, e.g. using tape or poster mounting clay, to a solid surface such as a door or wall.

Fastening means in the form of two sided tapes 41, 42 and 43 are provide on the inside surface 16 of the bag at strategic locations shown in FIGS. 1 and 2, so that when the bag is cut and unfolded, the tapes are used to mount the poster as shown in FIG. 5. Tapes 41, 42 and 43 include protective, removable strips, made for example of wax paper or the like, which are removed to expose the outer tape adhesive before the poster is to be mounted.

The image can include a logo, trademark or, generically, massage panel, e.g. at the right panel 24, which, with the bag converted, is at the top or bottom of the properly oriented image in the poster.

Alternatively the message can be in the middle of the poster image by placing the message on the left panel 23, at the approximate mid point of the image 14. An upright image 14 has its top at the left edge 31 and a reclining image 14 has its left side at the left edge 31. The terms "left" and "right" are, of course interchangeable within the scope of the claimed invention.

Figure 3:
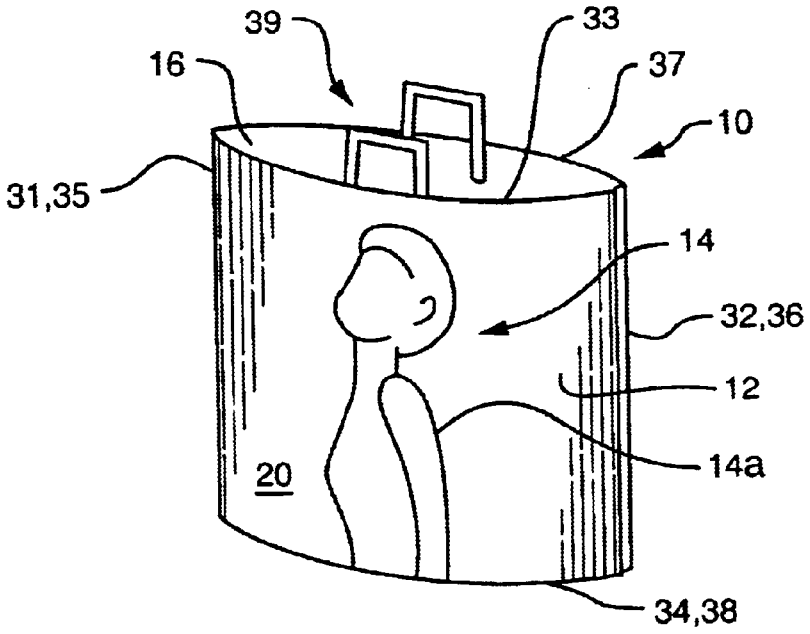
FIG. 3 is a view similar to FIG. 1 of a second embodiment of the invention.
Figure 4:
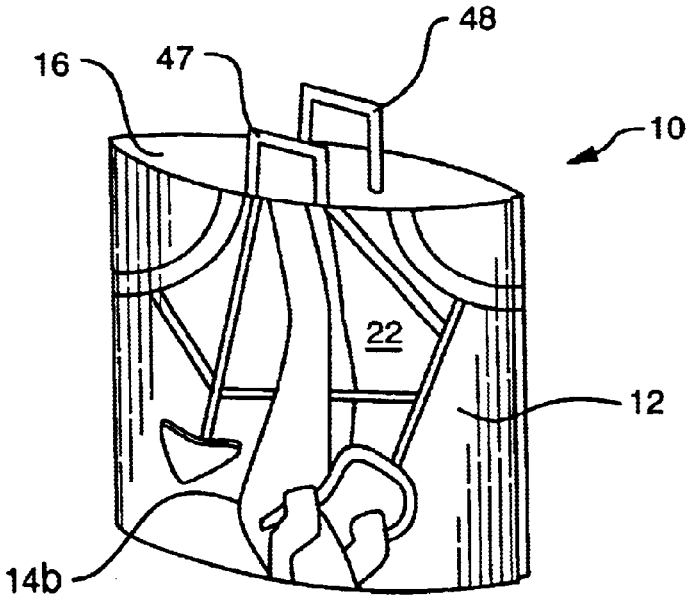
FIG. 4 is a view similar to FIG. 2 of the second embodiment of the invention.

FIGS. 3 and 4 illustrate a second embodiment of the invention without side or bottom panels. To form the poster such as poster 50 in FIG. 5, the left and right edges are cut and the front and rear walls are unfolded at the connected bottom edges.

Handles, such as rope handles 45 and 46 in FIG. 1, or paper handles 47 and 48 in FIG. 4, tha are conventional for the opening 39 of the shopping bags, are cut away of otherwise removed before mounting the poster. For the embodiment of FIG. 4, the top handle may be retained to function as a hanger for the poster.

While specific embodiments of the invention have been shown and described in detail to illustrate the application of the principles of the invention, it will be understood that the invention may be embodied otherwise without departing from such principles.

What is claimed is:

1. A convertible bag, comprising:

a sheet of material having an outer surface carrying an image with a selected orientation for viewing, the sheet also having an inner surface;

means for forming the sheet into a bag having at least a front wall with left, right, top and bottom edges, and a rear wall with left, right, top and bottom edges, the respective bottom, left and right edges being connected to each other to close a bottom and opposite sides of the bag, and the respective top edges being free and defining an opening for receiving and discharging goods to and from the bag, the inner surfaces of sheet at the walls facing each other on an interior of the bag;

the image having portions which are on at least part of each of the outer surfaces of the sheet at the front and rear walls so that with two of the connected bottom edges, left edges and right edges disconnected, the bag is unfolded at the remaining one of the connected edges to form a poster with all portions of the image in the selected orientation;

the sheet including a pair of side panels formed by parts of the sheet, the side panels being connected between the left and right edges of the front and rear walls with portions of the image spanning at least part of at least one of the side panels so that with the connected bottom and one of the left and right edges disconnected, the image extends from the front wall, across one of the side panels and onto the rear wall in the selected orientation.

2. A bag according to claim 1, wherein the sheet includes a bottom panel formed by part of the sheet, the bottom panel being connected between the bottom edges of the front and rear walls and having not part of the image in its selected orientation, the bottom panel being removed to form the poster.

3. A bag according to claim 1, wherein the image includes a message on one of the side panels which is in the selected orientation on the poster.

4. A convertible bag, comprising;

a sheet of material having an outer surface carrying an image with a selected orientation for viewing, the sheet also having an inner surface;

means for forming the sheet into a bag having at least a front wall with left, right, top and bottom edges, and a rear wall with left, right, top and bottom edges, the respective bottom, left and right edges being connected to each other to close a bottom and opposite sides of the bag, and the respective top edges being free and defining an opening for receiving and discharging goods to and from the bag, the inner surfaces of sheet at the walls facing each other on an interior of the bag;

the image having portions which are on at least part of each of the outer surfaces of the sheet at the front and rear walls so that with two of the connected bottom edges, left edges and right edges disconnected, the bag is unfolded at the remaining one of the connected edges to form a poster with all portions of the image in the selected orientation; and fastening means for hanging the posted attached to the inner surface of the sheet near at least one of the left and right edges, the fastening means comprising two sided tape.

5. A method for converting a bag into a poster, comprising the steps of:

providing a sheet of material having an outer surface carrying an image with a selected orientation for viewing, the sheet also having an inner surface, and means for forming the sheet into a bag having at least a front wall with left, right, top and bottom edges, and a rear wall with left, right, top and bottom edges, the respective bottom, left and right edges being connected to each other to close a bottom and opposite sides of the bag, and the respective top edges being free and defining an opening for receiving and discharging goods to and from the bag, the inner surfaces of sheet at the walls facing each other on an interior of the bag;

providing the image to have portions which are on at least part of each of the outer surfaces of the sheet at the front and rear walls;

disconnecting two of the connected bottom edges, left edges and right edges disconnected; and unfolded the bag at the remaining one of the connected edges to form the poster with all portions of the image in the selected orientation; and a pair of side panels formed by parts of the sheet, the side panels being connected between the left and right edges of the front and rear walls with portions of the image spanning at least part of at least one of the side panels so that with the connected bottom and one of the left and right edges disconnected, the image extends from the front wall, across one of the side panels and onto the rear wall in the selected orientation.

6. A method according to claim 5, wherein the sheet includes a bottom panel formed by part of the sheet, the bottom panel being connected between the bottom edges of the front and rear walls and having not part of the image in its selected orientation, the method including removing the bottom panel to form the poster.

7. A method according to claim 5, wherein the image includes a message on one of the side panels which is in the selected orientation on the poster.

8. A method for converting a bag into a poster, comprising the steps of:

providing a sheet of material having an outer surface carrying an image with a selected orientation for viewing, the sheet also having an inner surface, and means for forming the sheet into a bag having at least a front wall with left, right, top and bottom edges, and a rear wall with left, right, top and bottom edges, the respective bottom, left and right edges being connected to each other to close a bottom and opposite sides of the bag, and the respective top edges being free and defining an opening for receiving and discharging goods to and from the bag, the inner surfaces of sheet at the walls facing each other on an interior of the bag;

providing the image to have portions which are on at least part of each of the outer surfaces of the sheet at the front and rear walls;

disconnecting two of the connected bottom edges, left edges and right edges disconnected; and unfolded the bag at the remaining one of the connected edges to form the poster with all portions of the image in the selected orientation;

the bag including fastening means for hanging the poster attached to the inner surface of the sheet near at least one of the left and right edges, and the method including hanging the poster using the fastening means.

9. A method according to claim 8, wherein the fastening means comprises two sided tape.

* * * * *